US007500891B2

(12) United States Patent
Yazaki

(10) Patent No.: US 7,500,891 B2
(45) Date of Patent: Mar. 10, 2009

(54) OUTBOARD MOTOR

(75) Inventor: Makoto Yazaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/789,168

(22) Filed: Apr. 24, 2007

(65) Prior Publication Data

US 2007/0251490 A1 Nov. 1, 2007

(30) Foreign Application Priority Data

May 1, 2006 (JP) ..... 2006-127647

(51) Int. Cl.
*F02M 35/02* (2006.01)

(52) U.S. Cl. ..... 440/76

(58) Field of Classification Search ..... 440/76, 440/77; 123/195 C, 195 P
See application file for complete search history.

(56) References Cited

U.S. PATENT DOCUMENTS 6,183,322 B1 * 2/2001 Takahashi ..... 440/76
6,910,929 B2 * 6/2005 Yasuda et al. ..... 440/77
6,923,695 B2 * 8/2005 Ide et al. ..... 440/77

FOREIGN PATENT DOCUMENTS

JP 2004-338464 12/2004

* cited by examiner

*Primary Examiner*—Ed Swinehart
(74) *Attorney, Agent, or Firm*—Carrier, Blackman & Associates, P.C.; Joseph P. Carrier; William D. Blackman

(57) ABSTRACT

An outboard motor having a grommet mounted on a lower cover is disclosed. The grommet is positioned outward from an area directly under a surface in which an upper cover and lower cover meet as viewed from above. A presser cover for pressing the upper half of the grommet expands in the lateral direction and has on the lower end portion a first concavity that opens in the downward direction and conforms to the external shape of the grommet.

9 Claims, 9 Drawing Sheets

OUTBOARD MOTOR

FIELD OF THE INVENTION

The present invention relates to an outboard motor and, more particularly, to an improved engine cover structure that seals and covers the opening for introducing cables and the like into an engine compartment.

BACKGROUND OF THE INVENTION

In an outboard motor, an engine compartment that accommodates an engine is partitioned by a lower cover and an upper cover that constitute an engine cover. JP 2004-338464 A1 discloses a structure in which engine control cables, power supply cables, electric signal transmission cables, operation cables, and various other cables are introduced into the engine compartment.

In the arrangement of JP 2004-338464 A1, a concave notch is formed in an upper front portion of a lower cover, a cable introduction cover is mounted over the notch, and the two are joined together.

The cable introduction cover has an introduction hole in the front surface. A cylindrical rubber grommet is inserted in the introduction hole, and the cables are brought together and held in the grommet, whereby the cables are sealed.

The outboard motor has a notch formed in the lower cover, and a cable introduction cover through which a grommet is inserted and held is disposed on and integrated with the lower cover. The grommet is used for bringing together and holding cables 56 in the notch. Therefore, the grommet and the cables held by the grommet are disposed further below the lower edge of the upper cover mounted on the lower cover. Therefore, the grommet, which is a seal member, and cables are restricted by peripheral equipment, cable installation, wiring, and other factors in the engine compartment.

It is furthermore difficult to assure installation space for a connecting rod that is used when a plurality of outboard motors is mounted on the stem and the boat glides on water.

In view of the above, the preferred structure in an outboard motor is one in which the top surface of the grommet is positioned further above the lower edge of the upper cover and a large space is assured below the grommet.

SUMMARY OF THE INVENTION

According to an aspect of the present invention, there is provided an outboard motor which comprises an engine; an engine cover comprised of an upper cover and a lower cover that define an engine compartment for accommodating the engine; cable introduction portions disposed in the lower cover; and a grommet for sealing the cable introduction portions, wherein the grommet is positioned outward from an area directly under a surface in which the upper cover and lower cover meet as viewed in top plan, and a presser cover for pressing the upper half of the grommet expands in a lateral direction and has on a lower end portion a first concavity opening in a downward direction and conforms to an external shape of the grommet.

First, the grommet is disposed outward from the area directly under the surface in which the upper cover and lower cover meet as viewed from above, whereby the degree of freedom for positioning the grommet in relation to the engine cover is improved, and the grommet can be disposed above the lower edge of the upper cover. Furthermore, the presser cover, which presses the upper half of the grommet, expands in the lateral direction, and has on the lower end portion a first concavity that opens in the downward direction and conforms to the external shape of the grommet, whereby the position of the upper half of the grommet can be set high in a first concavity when the grommet is pressed and held by the presser cover, and the top surface of the grommet can be positioned above the lower edge of the upper cover. Therefore, the installation position of the cables bundled and held together by the grommet in the engine compartment can be made higher and the degree of freedom of wiring inside the engine compartment can be improved. Space below the grommet can be assured and installation space for a connection rod can easily be provided when a plurality of outboard motors is disposed in parallel.

Preferably, the lower cover has a notched concavity formed to accommodate the presser cover, while the lower cover have a second concavity opened in the upward direction in order to sandwich the grommet against the first concavity. As a result, the grommet is reliably held by a circular hole formed by a first concavity and a second concavity.

Desirably, the lower cover is comprised of left and right cover halves, while the second concavity of the lower cover is comprised of a receiver arm disposed on one side of a front bracket that links the space between the upper portion of the right and left cover halves. Therefore, a second concavity for directly supporting the lower half of the grommet does not need to be provided to the lower cover, and the structure of the lower cover can be simplified. Furthermore, the support surface that receives the lower half of the grommet can be increased, and the grommet can be more reliably held in place.

BRIEF DESCRIPTION OF THE DRAWINGS

A preferred embodiment of the present invention will be described in detail below, by way of example only, with reference to the accompanying drawings, in which.

DESCRIPTION OF THE PREFERRED EMBODIMENT

Figure 1:
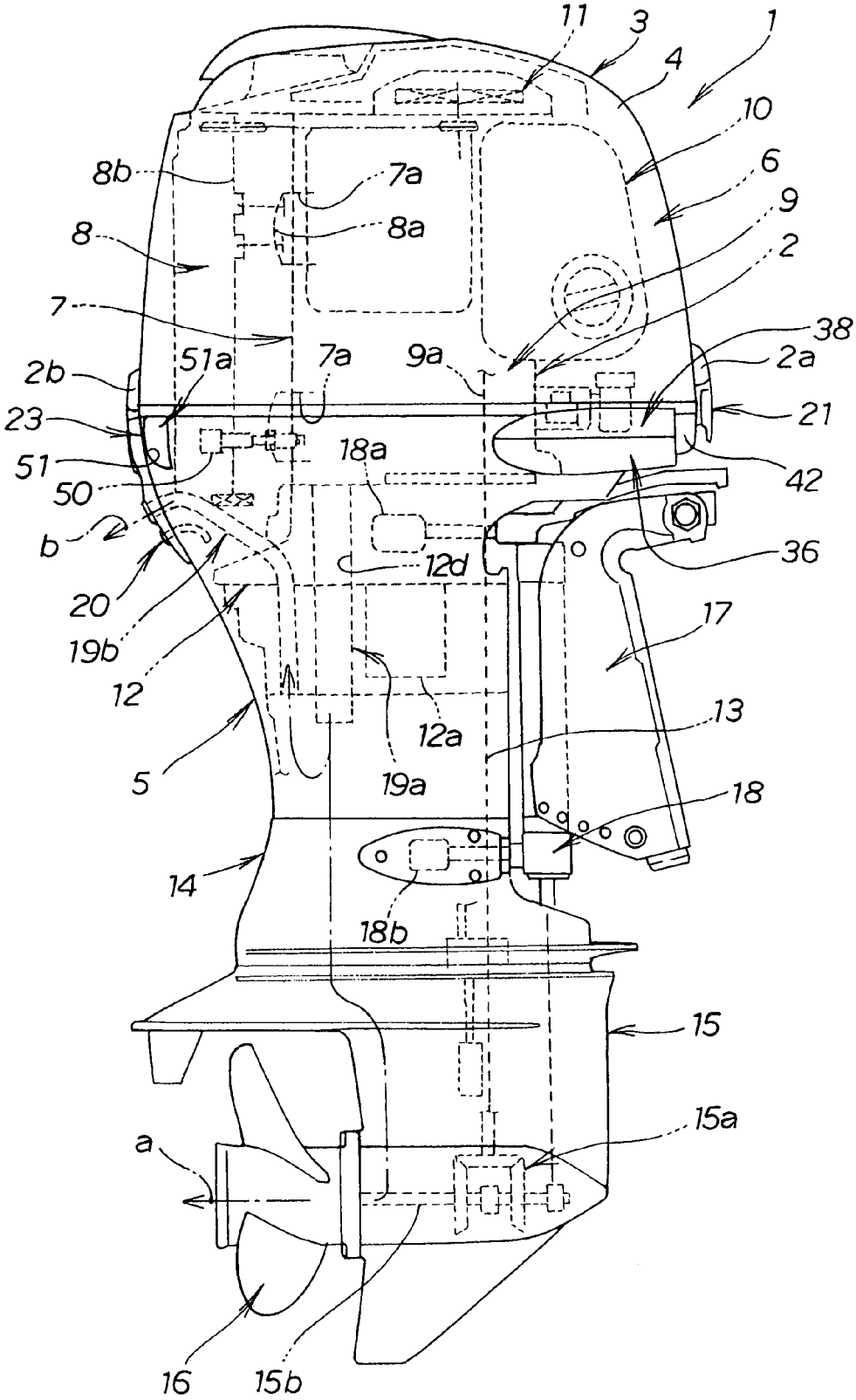
FIG. 1 is a side view of the outboard engine according to the present invention.
Figure 2:
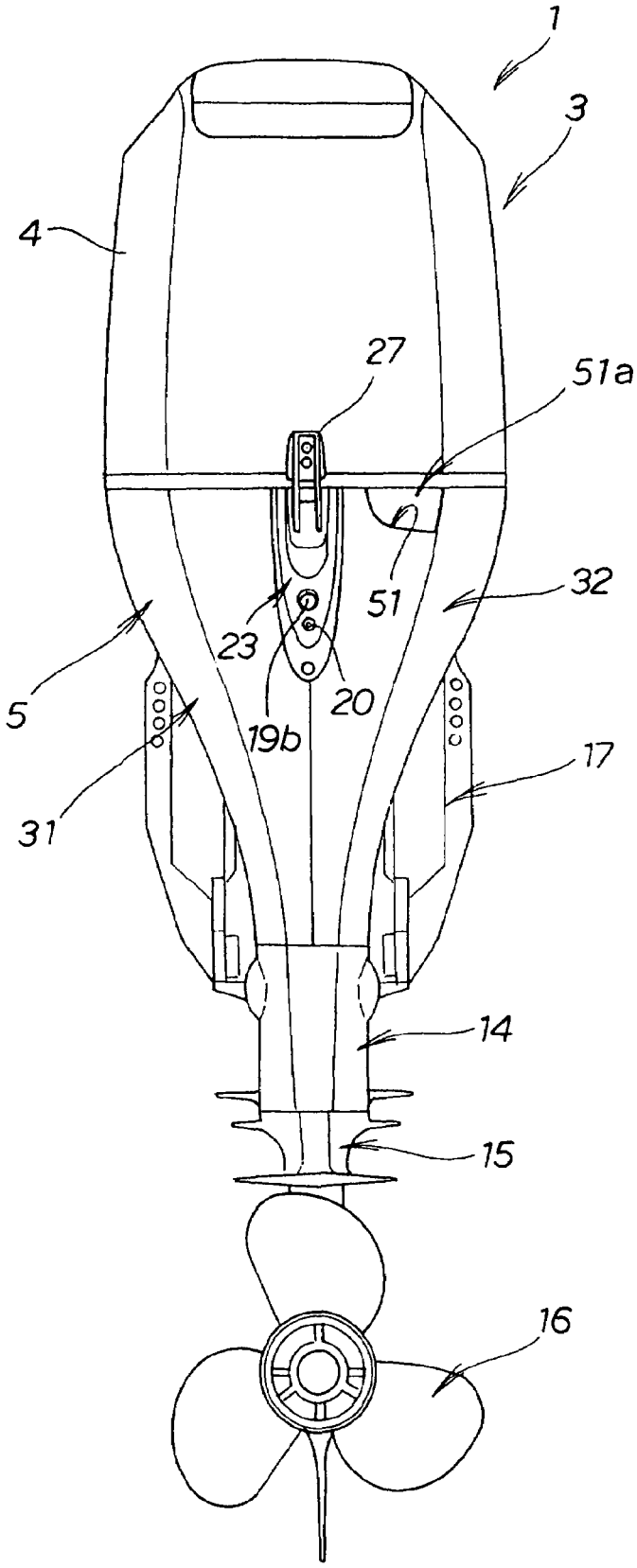
FIG. 2 is a rear view of the outboard engine shown in FIG. 1.

As shown in FIGS. 1 and 2, an outboard engine 1 has an engine 2 covered by an engine cover 3.

The engine cover 3 is composed of an upper cover 4 that covers the upper portion of the engine 2, and a lower cover 5 that covers the lower portion of the engine 2. An engine compartment 6 is partitioned by the upper and lower covers 4 and 5.

The engine 2 is a multi-cylinder four-stroke engine provided with substantially horizontally moving pistons and a vertically disposed crankshaft. The engine 2 is provided with a cylinder block 7, a cylinder head 8 disposed in the rear portion of the cylinder block 7, and a crankcase 9 disposed in the front portion of the cylinder block 7. The cylinder block 7 has a plurality of cylinders 7*a*. The cylinder head 8 has a plurality of combustion chambers 8*a* corresponding to the cylinders 7*a*. The reference numeral 8*b* is a camshaft. The crankcase 9 houses a vertically disposed crankshaft 9*a*.

An intake silencer 10 is disposed from the front portion of the right side of the crankcase 9 across the forward portion. A power generator (ACG) 11 is disposed above the engine 2.

The engine 2 is supported by a mounting case 12. The reference numeral 12*a* is an oil pan.

A crankshaft 9*a* is connected to a downwardly suspended drive shaft 13. The drive shaft 13 passes through the inside of an extension case 14 that is disposed below the bottom cover 5, and is connected to a gear transmission mechanism 15*a* inside a gear case 15 that is mounted on the lower end of the extension case 14.

The gear transmission mechanism 15*a* transmits the drive force of the drive shaft 13 to a horizontal driven shaft 15*b*. The rear end portion of the horizontal driven shaft 15*b* protrudes rearward from the gear case 15. A propeller 16 is mounted on the rear end portion of the horizontal driven shaft 15*b*. The propeller 16 is driven by the motive force of the engine 2. The outboard motor 1 produces forward or rearward propulsion by switching the direction of the propeller 16 with the aid of a pair of dog clutches.

A stem bracket 17 for mounting the outboard motor 1 on the stem is mounted on the front of the outboard motor 1 by way of a swivel case 18. The swivel case 18 is supported by mounting rubbers 18*a* and 18*b*.

Exhaust directed downward from the cylinder head 8 passes through a main exhaust channel 12*d* (FIG. 3) formed in the mounting case 12 and a main exhaust pipe 19*a* disposed downstream from the main exhaust channel 12*d*; subsequently passes through the interior of the lower cover 5, the extension case 14, and the gear case 15; and is then exhausted from the center of the propeller 16 into the water, as indicated by the arrow a.

A portion of the exhaust passes through a sub-exhaust pipe 19*b* adjacent to the primary exhaust pipe 19*a*, and is exhausted in the rearward direction of the outboard motor 1 as indicated by the arrow b.

A water test port 20 for visually confirming whether cooling water is flowing to the engine cooling unit is formed in the lower cover 5, and a portion of the cooling water is discharged in the rearward direction of the outboard motor 1.

An ignition plug 50 can be serviced by opening and closing a lid 51*a* that covers a notched portion 51 formed in the right cover half 32 (FIG. 2) of the lower cover 5 and removing and inserting the ignition plug.

The upper cover 4 is a resin molded article. The lower cover 5 is composed of divided left and right cover halves 31 and 32, and is a resin molded article. The left and right cover halves 31 and 32 are brought together and joined.

The structure of the lower cover 5 is described below with reference to FIG. 3.

The upper halves 31*a* and 32*a* of the left and right cover halves 31 and 32 are longer in the forward and rearward direction than the lower halves 31*b* and 32*b*. In other words, the front portions 31*d* and 32*d* of the upper halves 31*a* and 32*a* extend further in the forward direction than do the front portions 31*c* and 35*c* of the lower halves 31*b* and 32*b*.

The left and right cover halves 31 and 32 have an engaging groove portion 31*e* (in the diagram, the engaging groove portion of the right cover half 32 is hidden and cannot be seen) formed with bilateral symmetry at substantially the border between the upper halves 31*a* and 32*a* and the lower halves 31*b* and 32*b* on the inner surface of the left and right cover halves. When the left and right cover halves 31 and 32 are brought together and joined, a seal member 12*g* mounted around a flange portion 12*f* of the mounting case 12 is fitted into the engaging groove portion 31*e* to seal the space between the cover halves 31 and 32 and the mounting case.

The mounting case 12 is provided with a drive shaft vertical through-hole 12*c*, a hole 12*b* though which a shift rod inside a swivel shaft vertically passes, an engine-mounting flange 12*e*, an oil return aperture in an oil pan 12*a*, and a primary exhaust channel 12*d*.

The front bracket that connects the upper space between the left and right cover halves, the grommet that holds and seals the cables, and the presser cover body are described later.

Notched longitudinal engaging concave portions 31*g* and 32*g* are formed in the upper half of the rear portions 31*f* and 32*f* of the left and right cover halves 31 and 32. Mounting bosses 31*h* and 32*h* are disposed in the upper portions of the engaging concave portions 31*g* and 32*g*. The mounting bosses 31*h* and 32*h* have mounting holes 31*i* and 32*i*.

The upper rear portions of the left and right cover halves 31 and 32 are mounted on the engine side by way of a rear bracket 23. The sub-exhaust pipe 19*b* and a pipe 20*a* of the water test port 20 are positioned inside the lower cover 5.

Figure 3:
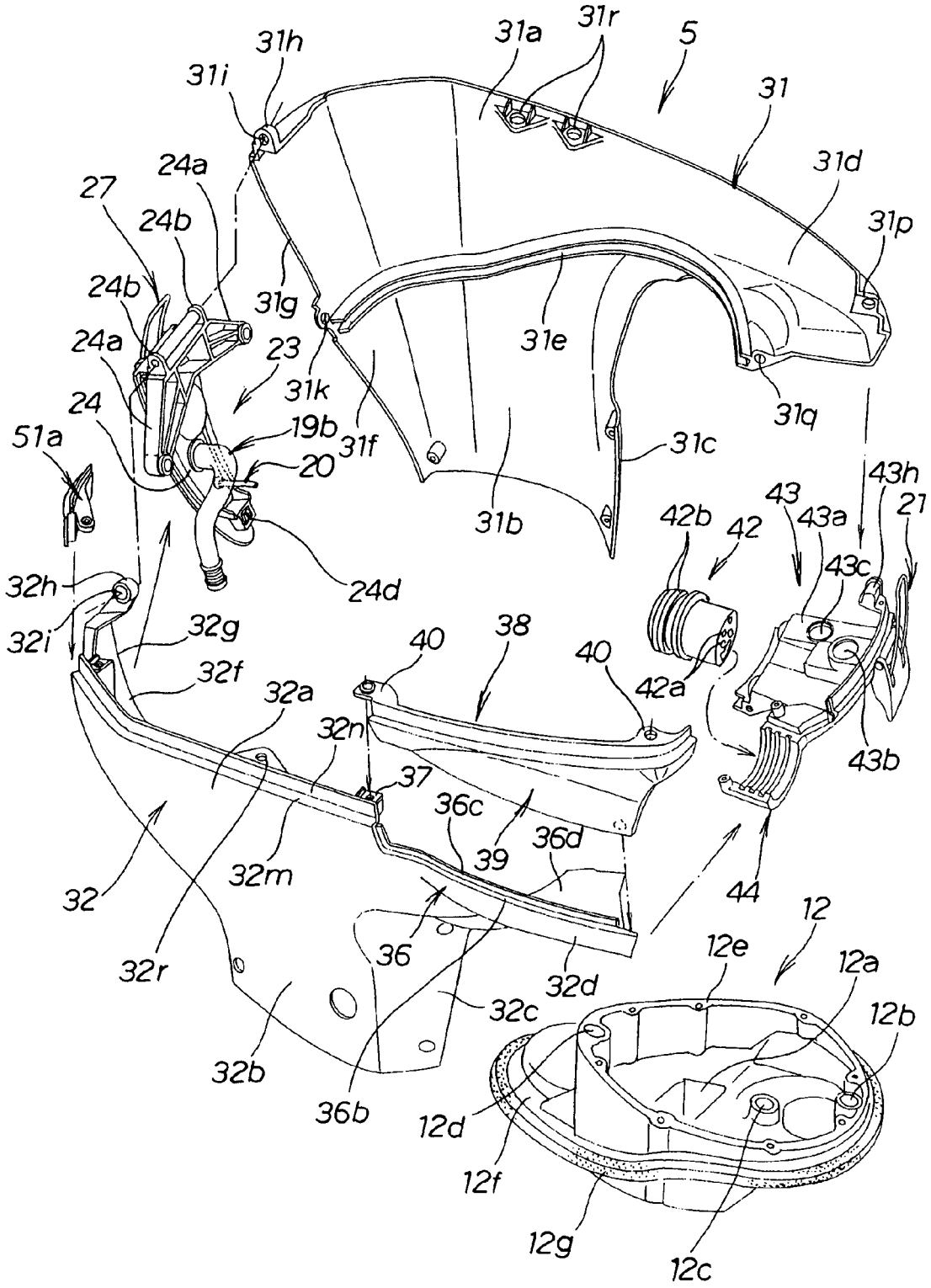
FIG. 3 is an exploded perspective view of the lower cover shown in FIG. 1.
Figure 4:
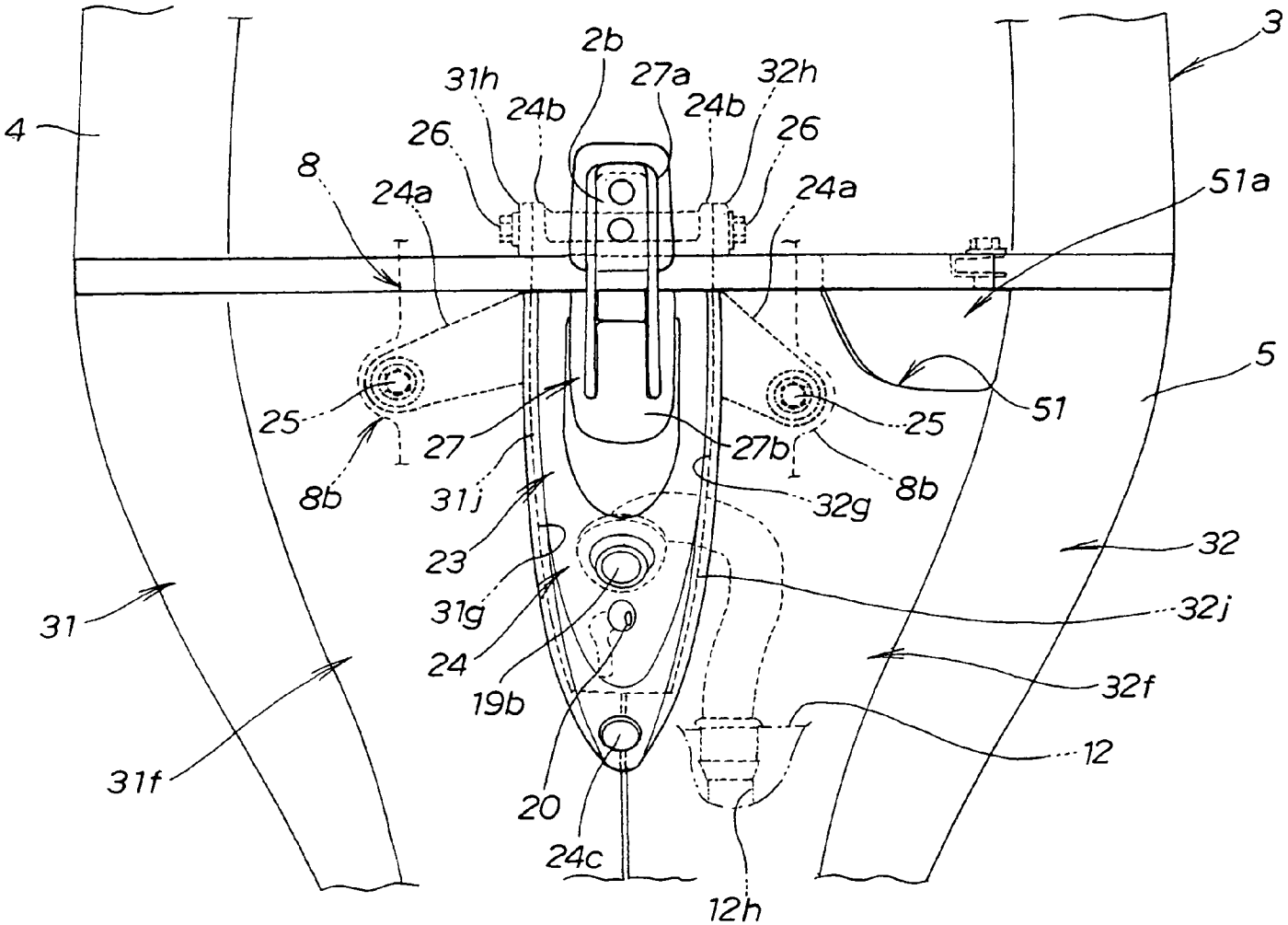
FIG. 4 is an enlarged view of the area around the rear bracket shown in FIG. 2.
Figure 5:
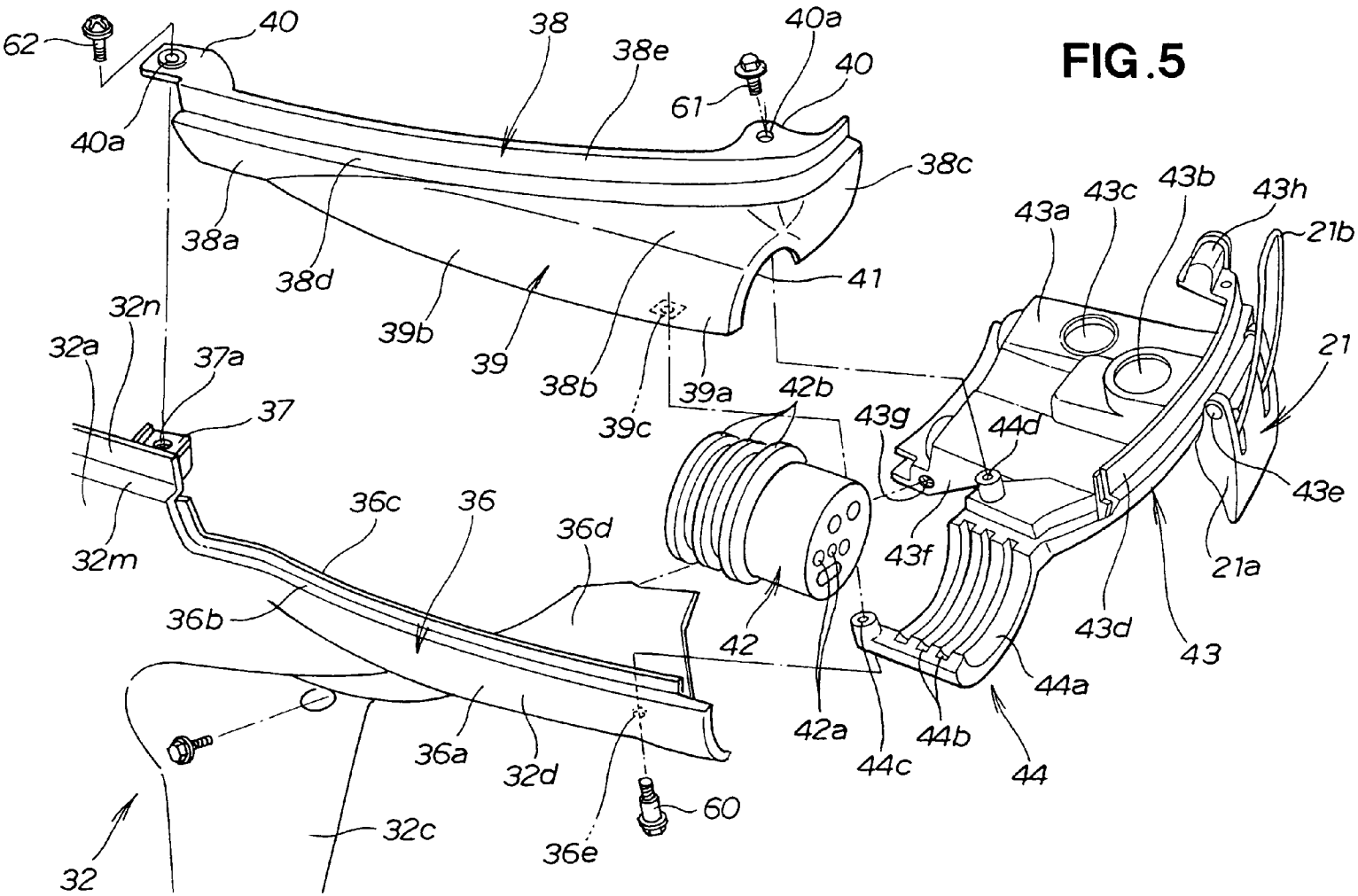
FIG. 5 is an enlarged view of the right cover half, grommets, and front bracket of the lower cover shown in FIG. 3.

The rear bracket 23 has a U-shaped flat main body 24, as shown in FIGS. 3 and 4. The flat main body 24 is exposed in the center portion of the rear surface of the lower cover 5. Support arms 24*a* and 24*a* curved in the form of a dogleg to the left and right are disposed inside the flat main body 24. The support arms 24*a* and 24*a* are fixed with the aid of bolts 25 and 25 to mounting eyes 8*b* and 8*b*, which are formed so as to protrude to the left and right of the cylinder head 8.

In the example shown in the diagram, the rear bracket 23 is mounted on the engine side, but the rear bracket may be mounted on the rear surface of the mounting case 12.

Concave grooves 31*j* and 32*j* are formed to the left and right of the main body 24 of the rear bracket 23. The edges of the engaging concave portions 31*g* and 32*g* of the left and right cover halves 31 and 32 are fitted into the concave grooves 31*j* and 32*j*.

Erect pieces 24*b* and 24*b* are disposed to the left and right on the upper portion of the rear bracket 23. Nuts, which are not shown, are embedded in the erect pieces 24*b* and 24*b*. The left and right mounting bosses 31*h* and 32*h*, which are disposed in protruding fashion in the vicinity of the joined portion of the left and right cover halves 31 and 32, are superimposed on the left and right erect pieces 24*b* and 24*b*, and bolts 26 and 26 are inserted by way of the mounting holes 31*i* and 32*i* and are screwed into the embedded nuts of the erect pieces 24*b* and 24*b*. The joined portion of the left and right cover halves 31 and 32 is thereby connected to the rear bracket 23.

A mounting hole 24*c* bored into the lower end of the bracket main body 24, and a mounting hole 31*k* formed in the lower portion of the engaging concave portions 31*g* and 32*g* (see FIG. 3; the right cover half 32 also has a mounting hole in the same manner, but the mounting hole is not visible in the diagram) are superimposed onto each other, and a decorative bolt is inserted and screwed into a nut 24*d* (see FIG. 3) disposed inside the main body 24 to connect the assembly.

Therefore, the component exposed behind the upper cover 4 and lower cover 5 is only the main body 24 of the rear bracket 23. The portions mounted on the engine 2, the portions mounted on the rear bracket 23 of the left and right cover halves 31 and 32, and other mounted portions are hidden by the covers.

In FIG. 4, an operation arm 27 is pivotably mounted on the rear bracket 23. The operation arm 27 has an inverted U-shaped latch post 27*a*. The latch post 27*a* engages a hook 2*b* when operated by a handle 27*b*, and locks the closed state of the upper cover 4 against the lower cover 5. The hook 2*b* is disposed on the upper cover 4.

The cover halves 31 and 32 have holding portions 31*r* and 32*r*, as shown in FIG. 3, and are held by an engine-side holder (not shown).

The sub-exhaust pipe 19*b* opens on the rear surface of the rear bracket 23. The water test port 20 also opens on the rear surface of the rear bracket 23 in the same manner. The sub-exhaust pipe 19*b* leads to a sub-exhaust channel 12*h* (FIG. 4) formed in the mounting case 12.

The mounting structure of the front bracket 43 for connecting the upper front portions of the left and right cover halves 31 and 32, the presser cover 38, and the grommet 42 that brings the cables together are described next with reference to FIG. 3 and FIGS. 5 to 9.

The upper edge of the front portion 32*d* of the upper half portion 32*a* of the right cover half 32 has a lower profile so as to accommodate the presser cover 38, and forms a concave conduit portion 36 that extends in the forward and rearward directions.

A side wall 36*a* of the conduit portion 36 is curved, opens in the rearward direction in the form of a half cylinder, and has a shape that expands in the lateral direction.

The upper edge of the conduit portion 36 has a narrow shelf portion 36*b* that is curved inward, and an erect rim 36*c* that stands erect at the inner edge of the shelf portion 36*b*. The rear end of the conduit portion 36 is L-shaped as viewed from the side. The upper edge of the rear end portion continues to a shelf surface 32*m*, which is a joining surface between the right cover half 32 and the lower edge of the upper cover 4. The shelf surface 32*m* has an erect rim 32*n* that stands erect at the inner edge of the shelf surface 32*m*. The erect rim 32*n* is in contact with the inner surface of the lower end of the upper cover 4.

An extended bottom piece 36*d* that extends inward is formed on the lower surface of the front portion of the conduit portion 36, and a mounting hole 36*e* is provided in the base portion of the extended bottom piece 36*d*.

A plate-shaped support portion 37, which internally houses a nut 37*a*, is disposed on the front end of the upper half portion 32*a* behind the conduit portion 36 of the right cover half 32.

Figure 8:
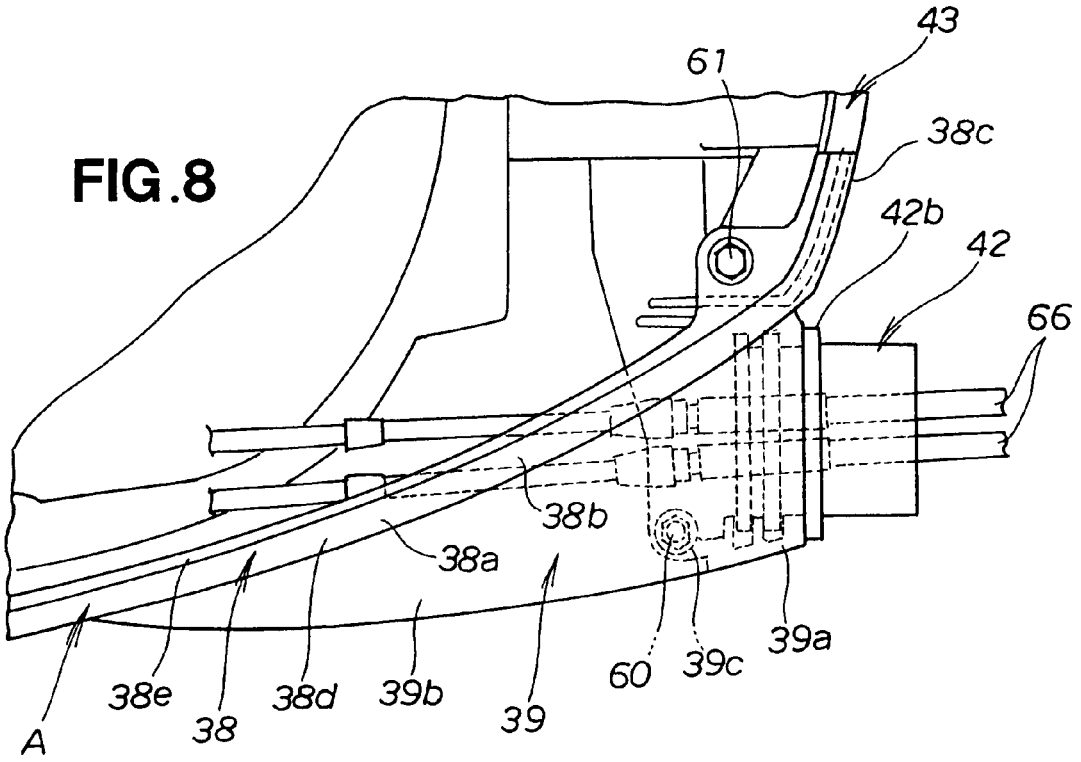
FIG. 8 is a view as seen in the direction of arrow 8 of FIG. 7, showing in front elevation the state in which the grommets have been mounted.

The presser cover 38 has an integrally formed expanding portion 39 that expands outward to the side of the cover main body 38*a* extending in the forward and rearward directions. The front portion 38*b* of the cover main body 38*a* is curved inward, as shown in FIG. 8. The front end 38*c* is substantially flat in the same manner as the front surface of the engine cover of the outboard motor.

The front portion 39*a* of the expanding portion 39 protrudes considerably outward as viewed from above, and the side portion 39*b* merges with the rear portion of the cover main body 38*a* while gradually expanding in the rearward direction. The cover main body 38*a* of the presser cover 38 has a shelf surface 38*d* on the upper end thereof. The shelf surface 38*d* has an erect rim 38*e* that stands erect at the inner edge thereof. The shelf surface 38*d* and erect rim 38*e* conform to the shelf surface 32*m* and the erect rim 35*n*.

Mounting eyes 40, 40 in which mounting holes 40*a*, 40*a* are respectively formed are provided in the forward and rearward end portions of the erect rim 38*e*.

A semicircular open portion 41 is formed in the front portion 39*a* of the expanding portion 39. The semicircular open portion 41 has a shape that conforms to the upper half portion of the grommet 42 shown in FIG. 5.

The grommet 42 is composed of rubber, synthetic rubber, or another sealing material, and the overall shape is a cylindrical shape that is long in the forward and rearward directions. The grommet 42 has a plurality of cable insertion holes 42*a* composed of round and square holes that pass completely through the grommet in the axial direction. A plurality of seal lips 42*b* is provided in protruding fashion in the form of a ring in the external peripheral portion of the grommet 42. The grommet 42 provides support so that cables can be brought in and out of the engine compartment by way of the cable insertion holes 42*a*. Examples of the cables include an engine control cable for opening and closing a throttle valve, a drive control cable for switching between forward and rearward propulsion, a power supply cable, signal transmission cables, and a fuel supply tube.

Figure 6:
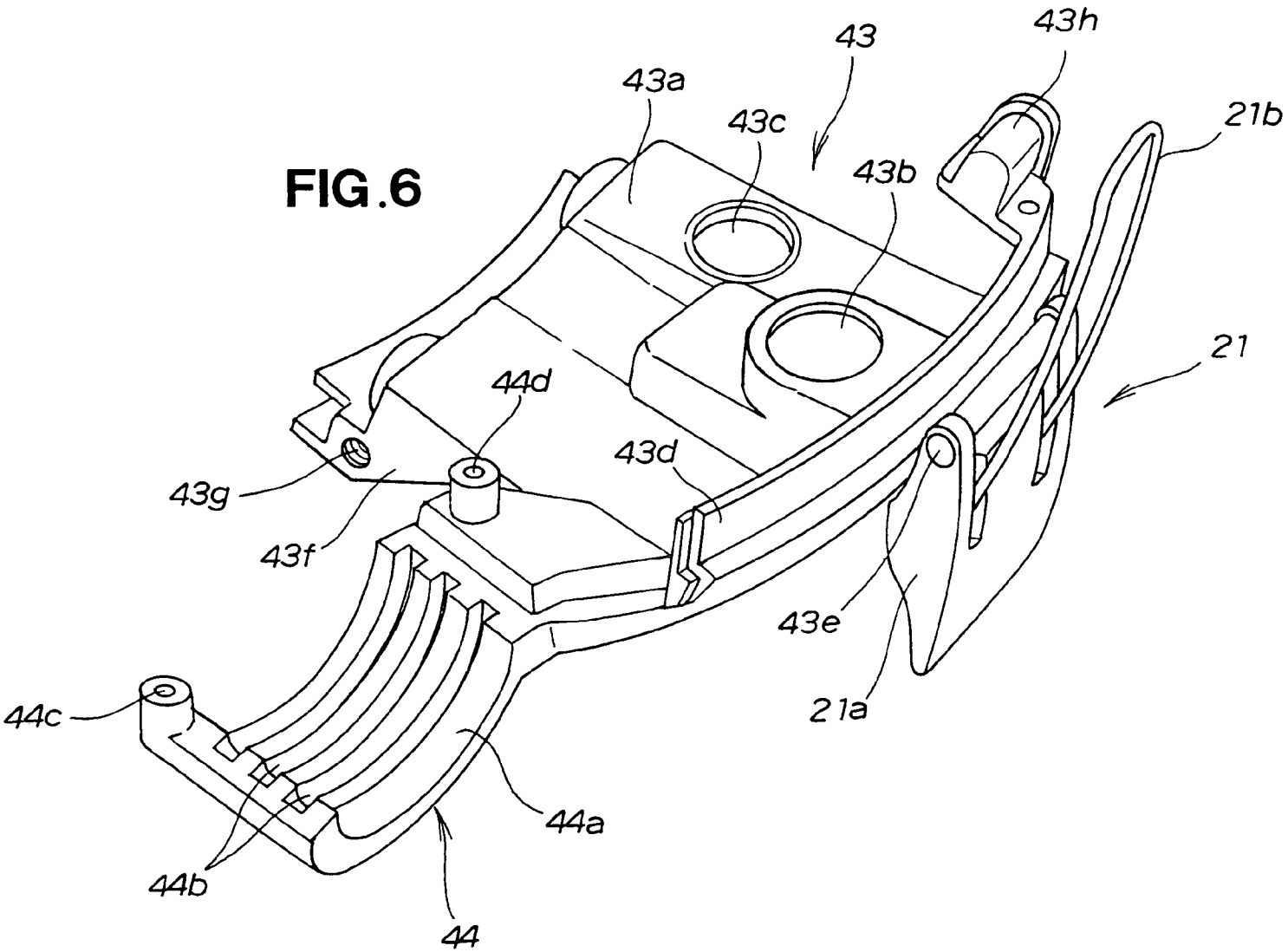
FIG. 6 is a perspective view of the front bracket shown in FIG. 5.

The front bracket 43 has an insertion hole 43*b* for a swivel shaft formed in a bracket main body 43*a* in the form of a shelf board, and a power cord insertion hole 43*c* for a hydraulic tilt and trim cylinder device, as shown in FIG. 6.

The bracket main body 43*a* has an erect wall 43*d* that is curved as viewed from above and is formed in the front end of the bracket main body. An engine cover operation arm 21 for engaging and locking the upper and lower covers 4 and 5 (FIG. 1) is supported on a support shaft 43*e* mounted on the front portion of the erect wall 43*d*. A handle 21*a* of the engine cover operation arm 21 is pivotably mounted on the support shaft 43*e*. An inverted U-shaped lock post 21*b* interlocks with a pawl 2*a* disposed on the lower portion of the center portion of the upper cover 4 (FIG. 1) by operating the handle 21*a*, and locks the upper cover 4 and lower cover 5.

A receiver arm 44 that supports the lower half portion of the grommet 42 extends from the right side of the front bracket 43. The receiver arm 44 has a semicircular upward-facing concave portion 44*a* as viewed from the front. The semicircular concave portion 44*a* has a shape that conforms to the lower half portion of the grommet 42. The inner surface of the receiver arm 44 has a plurality of grooves 44*b* set at a distance from each other in the axial direction.

The receiver arm 44 has a mounting hole 44*c* formed in the outer end rear portion of the receiver arm. A mounting hole 44*d* is formed in the outward portion of the bracket main body 43*a* in the base portion side of the receiver arm 44.

The bracket main body 43*a* has a substantially triangular rib wall 43*f* formed in the rear portion of the right side of the bracket main body. A mounting screw hole 43*g* that faces in the width direction of the outboard motor is formed in the rib wall 43*f*.

A mounting portion 43*h* curved in the rearward direction is formed in the right-side end portion of the erect wall 43*d* of the front bracket 43. The mounting portion 43*h* has a screw hole.

The front bracket 43 is mounted in the space between the upper portions of the front surfaces of the left and right cover halves 31 and 32, as shown in FIG. 3.

The outer end portion of the receiver arm 44 is mounted on the conduit portion 36 by inserting a stepped bolt 60 into the mounting hole 44*c* and the mounting hole 36*e* formed in the conduit portion 36 of the right cover half 32, and screwing the stepped bolt 60 into the nut 39*c* disposed in the expanding portion 39 of the presser cover 38 that has been placed on the conduit portion 36. The base portion of the receiver arm 44 is mounted on the presser cover 38 by inserting a stepped bolt 61 into the mounting hole 44*d* and the mounting hole 40*a* formed in the front mounting portion 40 of the presser cover 38, and tightening the bolt.

The rear end portion of the presser cover 38 is mounted on the right cover half 32 by inserting a bolt 62 into the mounting hole 40*a* of the front mounting portion 40, and screwing the bolt 62 into a nut 37*a* of the support portion 37 of the right cover half 32. A bolt 63 is furthermore inserted into a through-hole 35*p* (FIG. 7) provided in the lower front portion of the right cover half 32, the bolt 63 is screwed into the mounting screw hole 43*g* formed in the rib wall 43*f* of the front bracket 43, and the right cover half 32 and the front bracket 43 are fastened together.

Figure 7:
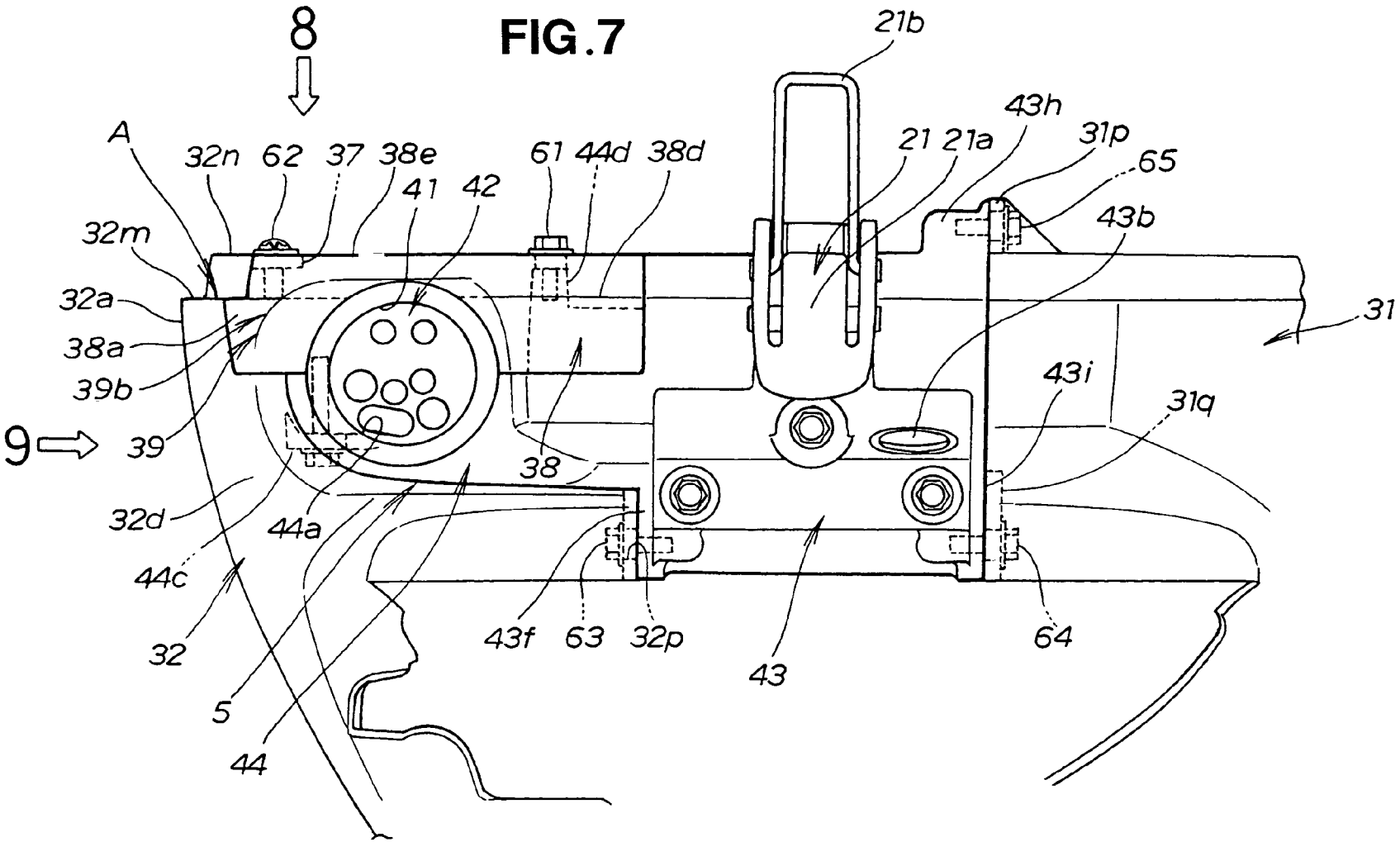
FIG. 7 is a front view showing a state in which the front bracket and grommets have been mounted on the lower cover.

The front bracket 43 also has a rib wall 43*i* on the side opposite of the rib wall 43*f*, as shown in FIG. 7. The rib wall 43*i* is fastened with the aid of a bolt 64 to the mounting portion 31*q* provided in the left cover half 31. The mounting portion 43*h* of the front bracket 43 is mounted with the aid of a bolt 65 to the mounting portion 31*p* formed in the upper portion of the left cover half 31.

In this manner, the left and right cover halves 31 and 32 are connected by way of the front bracket 43. When the presser cover 38 is mounted on the receiver arm 44 of the front bracket 43, a circular hole is formed that sandwiches the grommet 42 between the semicircular open portion 41 of the presser cover 38 and the semicircular concave portion 44*a* of the receiver arm 44.

The grommet 42 has a plurality of seal lips 42*b* in the form of a ring disposed in protruding fashion on the external periphery of the grommet. The seal lips 42*b* engage a plurality of semicircular grooves 44*b* formed in the receiver arm 44, the grommet 42 is reliably held by the presser cover 38 and the front bracket 43, and exceptional sealing characteristics can be provided by the plurality of seal lips 42*b* and the plurality of grooves 44*b*.

Figure 9:
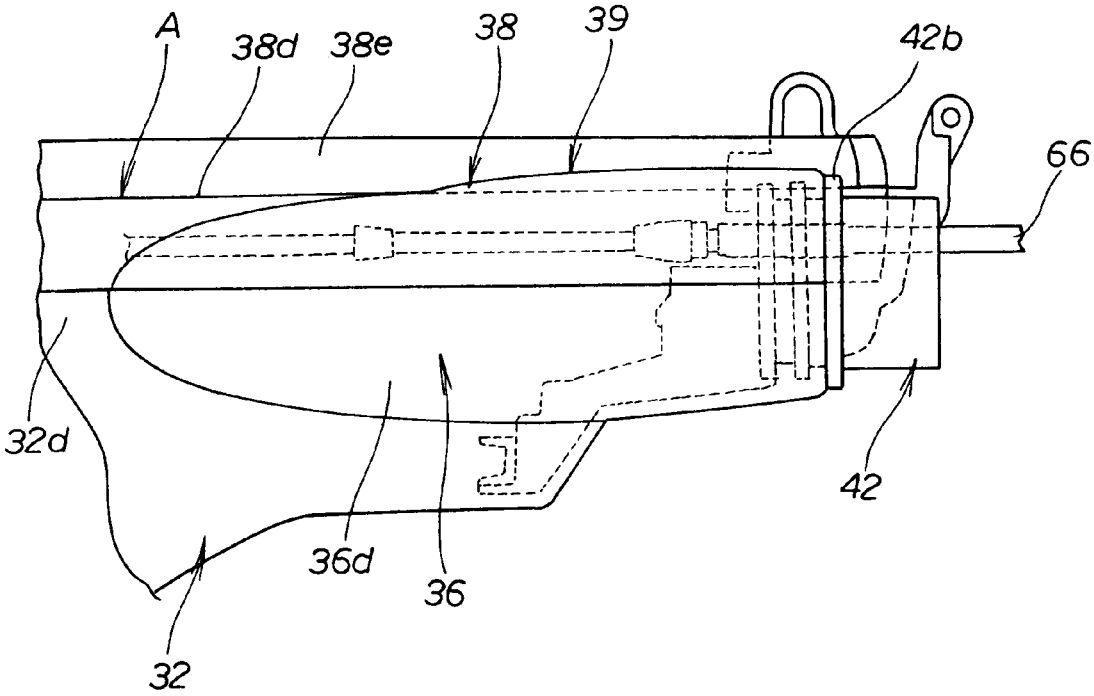
FIG. 9 is a view as seen in the direction of arrow 9 of FIG. 7, showing in side elevation the state in which the grommets have been mounted.

As shown in FIGS. 8 and 9, the grommet 42 is positioned outward from the area directly under the surface in which the upper cover and lower cover meet as viewed from above. The upper surface of the grommet 42 is essentially positioned on the upper edge, as indicated by the reference symbol A, of the right cover half 32 of the lower cover 5 that is in contact with the lower edge of the upper cover 4, i.e., is essentially positioned on the shelf surface 38*d* of the presser cover 38, which is in the same plane as the upper edge A.

Therefore, a large space can be secured below the grommet 42 because the upper surface of the grommet 42 is positioned above the lower edge of the upper cover 4.

Figure 10:
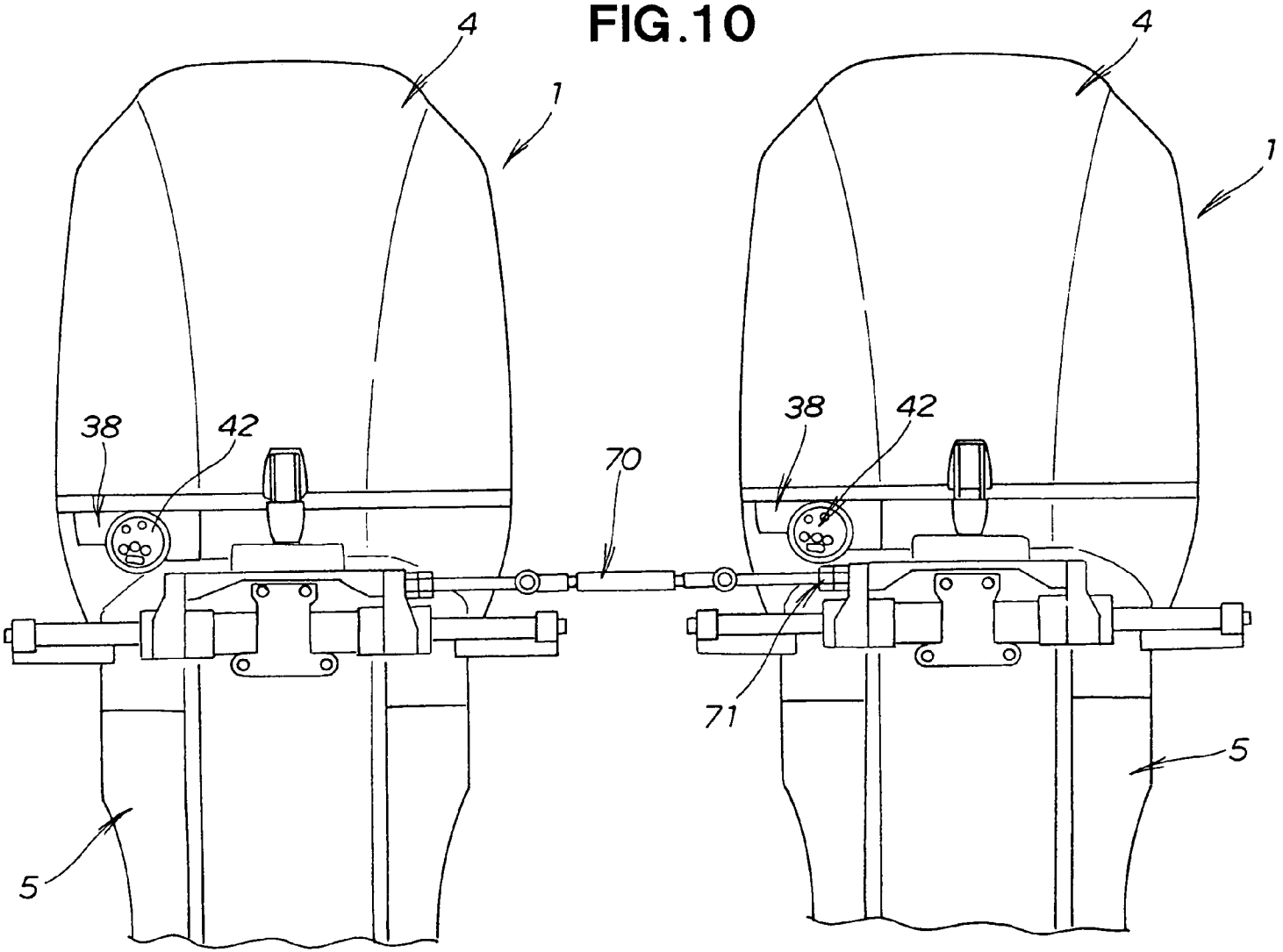
FIG. 10 is a view showing a state in which two outboard motors are mounted in parallel.

For this reason, a plurality of outboard motors, e.g., two outboard motors 1 and 1, can be connected by a connecting rod 70 when the motors are disposed in parallel as shown in FIG. 10. The connecting portion 71 of the connecting rod 70 is positioned below the grommet 42 of one of the outboard motors 1, and the grommet 42 is positioned above the lower cover 5 as described above. Therefore, the degree of freedom in disposing the connecting portion 71 of the connecting rod 70 is improved. The options for selecting a commercially-available connecting device are thereby increased, and since a space is obtained below the grommet 42, the work for connecting a plurality of outboard motors is facilitated, and the degree of freedom for laying out, disposing, or otherwise positioning cables is further improved.

Obviously, various minor changes and modifications of the present invention are possible in light of the above teaching. It is therefore to be understood that within the scope of the appended claims the invention may be practiced otherwise than as specifically described.

What is claimed is:

1. An outboard motor comprising:

an engine;

an engine cover comprising an upper cover and a lower cover; said engine cover defining an engine compartment for accommodating the engine;

cable introduction portions disposed in the lower cover;

a grommet for sealing the cable introduction portions; and a presser cover for pressing an upper half of the grommet; wherein:

the grommet is positioned outwardly from an area directly under a surface in which the upper cover and lower cover meet as viewed in top plan view;

the presser cover extends outward in a lateral direction and has a first concavity formed on a lower end portion thereof opening in a downward direction;

the presser cover conforms to an external shape of the grommet;

the lower cover has a notched concavity formed to accommodate the presser cover, and a second concavity opened in an upward direction so as to sandwich the grommet against the first concavity; and the lower cover comprises left and right cover halves, and the second concavity of the lower cover comprises a receiver arm disposed on one side of a front bracket that links a space between the upper portion of the right and left cover halves.

2. An outboard motor comprising:

an engine;

an engine cover comprising an upper cover and a lower cover; said engine cover defining an engine compartment for accommodating the engine;

cable introduction portions disposed in the lower cover;

a grommet for sealing the cable introduction portions; and a presser cover for pressing an upper half of the grommet; wherein:

the grommet is positioned outwardly from an area directly under a surface in which the upper cover and lower cover meet as viewed in top plan view;

the presser cover extends outward in a lateral direction and has a first concavity formed on a lower end portion thereof opening in a downward direction;

the presser cover conforms to an external shape of the grommet; and said grommet includes a plurality seal lips formed thereon, and the lower cover includes a second concavity opened in an upward direction so as to sandwich the grommet against the first concavity, said second concavity having a plurality of grooves formed therein corresponding to said plurality of seal lips.

3. An outboard motor comprising:

an engine;

an engine cover having an upper cover and a lower cover operatively joined to the upper cover; said engine cover surrounding the engine;

said lower cover having a cable introduction port formed therein;

a grommet disposed in the cable introduction port and providing sealing thereto; said grommet having a lower half and an upper half; and a presser cover for pressing the upper half of the grommet; wherein:

said presser cover has a first concavity formed therein in a downward direction;

the lower cover has a second concavity formed therein in an upward direction corresponding to the first concavity;

said first concavity and said second concavity enclose a portion of a longitudinal section of the grommet therebetween;

a remaining portion of said longitudinal section of the grommet extends outwardly from an area directly under a surface in which the upper cover and lower cover meet when viewed in a top plan view;

said lower cover includes left and right cover halves, and a front bracket having said second concavity formed thereon; and said front bracket is disposed between said left and right covers.

4. An outboard motor according to claim 3, wherein the presser cover conforms to an external shape of the grommet, and extends outward in a lateral direction thereof.

5. An outboard motor according to claim 3, wherein said lower cover further has a notched concavity formed therein to accommodate a portion of the presser cover.

6. An outboard motor according to claim 3, wherein said grommet is formed of a material comprising one of a rubber and a synthetic rubber.

7. An outboard motor according to claim 3, wherein said grommet further has a plurality of cable insertion holes formed therein.

8. An outboard motor comprising:

an engine;

an engine cover having an upper cover and a lower cover operatively joined to the upper cover; said engine cover surrounding the engine;

said lower cover having a cable introduction port formed therein;

a grommet disposed in the cable introduction port and providing sealing thereto; said grommet having a lower half and an upper half; and a presser cover for pressing the upper half of the grommet; wherein:

said presser cover has a first concavity formed therein in a downward direction;

the lower cover has a second concavity formed therein in an upward direction corresponding to the first concavity;

said first concavity and said second concavity enclose a portion of a longitudinal section of the grommet therebetween;

a remaining portion of said longitudinal section of the grommet extends outwardly from an area directly under a surface in which the upper cover and lower cover meet when viewed in a top plan view; and said grommet includes a plurality seal lips, and the second concavity has a plurality of grooves corresponding to said plurality of seal lips.

9. An outboard motor comprising:

an engine;

an engine cover having an upper cover and a lower cover operatively joined to the upper cover; said engine cover surrounding the engine;

said lower cover having a cable introduction port formed therein;

a grommet disposed in the cable introduction port and providing sealing thereto; said grommet having a lower half and an upper half; and a presser cover for pressing the upper half of the grommet; wherein:

said presser cover has a first concavity formed therein in a downward direction;

the lower cover has a second concavity formed therein in an upward direction corresponding to the first concavity;

said first concavity and said second concavity enclose a portion of a longitudinal section of the grommet therebetween;

a remaining portion of said longitudinal section of the grommet extends outwardly from an area directly under a surface in which the upper cover and lower cover meet when viewed in a top plan view;

said grommet includes a plurality circular seal lips, and the lower cover includes a receiver arm having a plurality of semicircular grooves formed therein corresponding to said plurality of circular seal lips; and said grommet is disposed between the presser cover and the receiver arm.

* * * * *